US006766838B1

(12) United States Patent
Zywicki

(10) Patent No.: US 6,766,838 B1
(45) Date of Patent: Jul. 27, 2004

(54) LIQUID DISPENSING DEVICE

(75) Inventor: Eugene E. Zywicki, Ottawa (CA)

(73) Assignee: KAZwik Canada Inc., Ottawa (CA)

( * ) Notice: Subject to any disclaimer, the term of this patent is extended or adjusted under 35 U.S.C. 154(b) by 0 days.

(21) Appl. No.: 10/698,491

(22) Filed: Nov. 3, 2003

(51) Int. Cl.[7] ..... B65B 1/04

(52) U.S. Cl. ..... 141/286; 141/14; 141/301; 222/204; 222/532; 222/566

(58) Field of Search ..... 141/286, 301, 141/302, 14; 222/566, 204, 532

(56) References Cited

U.S. PATENT DOCUMENTS 289,585 A * 12/1883 Veber ..... 222/394
3,010,614 A * 11/1961 Udy ..... 222/204
5,131,591 A * 7/1992 Gill ..... 239/74
5,419,467 A 5/1995 Maguire et al.
5,617,891 A 4/1997 True
6,006,961 A 12/1999 Wark
6,412,528 B1 7/2002 Alex et al.

* cited by examiner

*Primary Examiner*—Steven O. Douglas
(74) *Attorney, Agent, or Firm*—Marks & Clerk

(57) ABSTRACT

An improved dispensing device for liquids held in enclosed containers. The dispensing device attaches to the container opening normally used for pouring the liquid. Once attached, the dispensing device first acts like a siphon, then can be switched to operate like a standard pouring spout in order to completely empty the container of all liquid without removing the dispensing device.

16 Claims, 7 Drawing Sheets

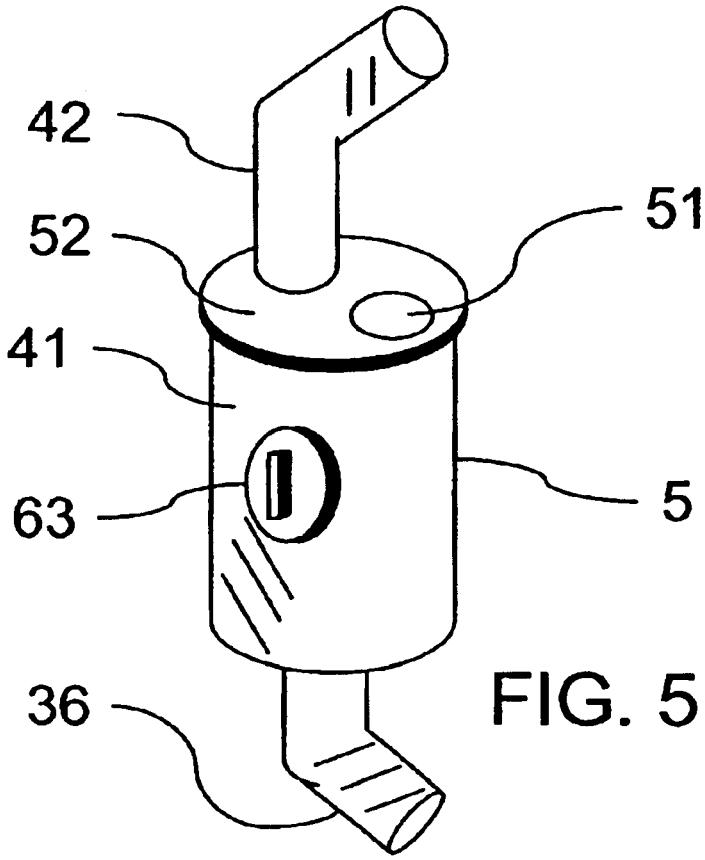
FIG. 5
FIG. 6
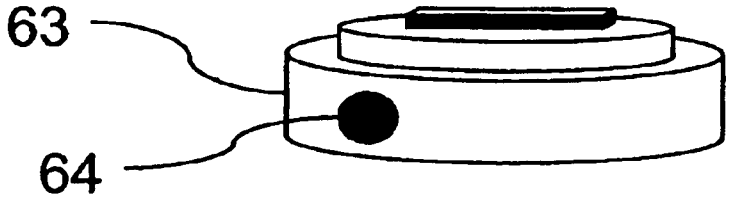

LIQUID DISPENSING DEVICE

FIELD OF THE INVENTION

This invention relates to the field of liquid handling, and more particularly to a dispensing device for transferring liquid from a portable container to another container.

BACKGROUND OF THE INVENTION

The problems associated with transferring liquids from portable containers generally fall into one of two categories; dispensing the liquid; and controlling the flow of liquid. Although it is possible to use a pump for dispensing the liquid, it is generally impractical for portable containers due to the size; cost and power requirements of pumps. The most common dispensing method is to tip the container and pour the contents. While the pouring method is quite manageable for small and medium sized containers, maintaining control over a twenty-five liter container weighing between twenty and twenty-five kilograms when full of gasoline or water can be a significant challenge. Spouts and funnels help control the liquid during the pouring process and prevent most spillage, but the basic problem of handling a heavy container still exists. Another dispensing solution is the siphon. While the siphon does not require constant holding of the container thus solving one problem, there remain the issues of initiating the flow of the liquid as well as how to completely drain the container since a siphon typically leaves some of the liquid at the bottom of the container. Initiating the flow of liquid can be accomplished by sucking on the end of the hose used to dispense the liquid into the receiving container, however the person sucking on the hose often ends up with some of the liquid in his mouth. Ingesting a small amount of liquid may not be a problem if the liquid is water, but it is very unpleasant and unhealthy if the liquid is gasoline. Should the person manage to avoid getting liquid in his mouth, there is still the matter of getting the dispensing hose into the receiving container before liquid rushes from the end of the hose. As for leaving some liquid in the container, portable containers are typically used in situations where the liquid being dispensed is not readily available, therefore it is highly desirable to quickly and easily dispense all of the liquid.

Some examples of prior art in the area of liquid dispensing devices are U.S. Pat. Nos. 5,419,467, 5,617,891, 6,006,961 and 6,412,528. U.S. Pat. No. 5,419,467 describes a pouring spout for controlling of the flow of liquid. As discussed previously, spouts do very little to aid in the handling of large, heavy containers while dispensing the liquid. U.S. Pat. No. 6,006,691 describes a hose adapter that allows the use of existing garden hoses for dispensing gasoline. In this way longer hoses may be used, thus reducing the distance one must carry a large can of gasoline. Again, this device does nothing to reduce the lifting required to empty the gas can. U.S. Pat. No. 5,617,891 describes a container cover that combines a siphon pipe along with an air pipe. When used to cover the opening of an otherwise sealed container, air can be forced into the container via the air pipe causing liquid to flow out the siphon pipe thus initiating the flow of liquid. U.S. Pat. No. 6,412,528 describes a siphon pump that has a bellows siphon in-line with the liquid flow. The bellows siphon provides the means for initiating the flow of liquid. U.S. Pat. Nos. 5,617,891 and 6,412,528 both use siphons which overcome the container handling problem, and both provide a convenient means for initiating the flow of liquid. In the case of U.S. Pat. No. 6,412,528, the complexity of a bellows siphon which is in-line with the liquid flow makes the device less reliable and more expensive to manufacture when compared to other portable container dispensing solutions. Additionally as described previously, both siphon devices have the problem of not being able to dispense all the liquid in a container. In order to pour out the liquid that remains after the siphoning process, one would have to remove the siphon pump or siphon cap and then revert to a spout or funnel mechanism.

SUMMARY OF THE INVENTION

With the foregoing in mind, it is an object of this invention to provide a simple, reliable, inexpensive dispensing device that eliminates the difficult handling of large, heavy containers during the dispensing process, while easily permitting the containers to be completely emptied.

The dispensing device of this invention is suitable for a variety of liquids, however for the purpose of this description the example of a gasoline dispensing device will be used.

Standard gas cans consist of an enclosed container with two openings on the top surface. The larger opening is intended for filling and emptying the can and is called the filler opening, while the smaller opening is intended to ventilate the can during the filling or dispensing process and is called the vent. Both openings have threaded mouths onto which corresponding threaded caps may be secured. The cap for the larger opening is called the filler cap, while the cap for the smaller opening is called the vent cap. With both caps secured the container will not leak vapours or liquids, a useful feature during storage and transportation. Typically the filler cap is comprised of two pieces, a threaded ring cap and a lid. The lid fits inside the ring cap and forms the top of the filler cap. In addition, most gas cans come supplied with a pouring spout stored inside the mouth of the filler opening. During dispensing, the lid is removed from the filler cap, the spout is inserted into the filler cap and the filler cap with spout is threaded onto the filler opening. The vent cap is loosened so that air may enter the can as gasoline is dispensed.

In a preferred embodiment, the present invention replaces the spout in the standard gas can and is comprised of a pouring spout, a siphon pipe, an intake pipe, and a valve. The present invention forms a tight seal against the filler opening preventing vapour and fluid leakage. The siphon pipe connects to the valve and extends from the base of the body of the dispensing device into the gas can. A hose of suitable length to reach to the bottom of the gas can is attached to the protruding end of the siphon pipe. The intake pipe connects to the valve and terminates in an opening at the base of the dispensing device. The pouring spout connects to the valve and extends from the top of the body of the dispensing element. A hose of suitable length to reach the container receiving the gasoline is attached to pouring spout. The valve is adjustable and connects either one of the two pipes to the pouring spout, or connects the two pipes together preventing any liquid from leaking out of the container.

Alternatively, the present invention could include the ring cap function and replace both the spout and ring cap in the standard gas can.

In operation the following steps will dispense all the liquid from a gas can.

Place the gas can on a surface positioned at a height above the container receiving the dispensed gasoline. Secure the dispensing device onto the filler opening of the gas can and open the vent cap. Place the dispensing hose connected to the pouring spout into the receiving container. Adjust the valve to the "Siphon" position, thus connecting the siphon pipe to the pouring spout. Tip the gas can until the level of the gas inside the can is above the highest point of the dispensing hose, and wait until gasoline starts to flow into the receiving container. Return the gas can to the resting position. Gasoline will now flow into the receiving container until the level of the gasoline inside the gas can is below the bottom of the siphon hose. Adjust the valve to the "Pour" position, thus connecting the intake pipe to the pouring spout. Tip the gas can until gasoline flows into the receiving container. Since there is very little gas in the can, the gas can is not heavy and can easily be held in an inverted position to drain the remaining gasoline.

During the siphoning process the flow of gasoline may be halted at any time by, adjusting the valve to the "Off" position, blocking all liquid flows to the pouring spout by connecting the siphon pipe to the intake pipe. Although the key to halting the flow of gasoline is blocking the flows from the siphon and intake pipes to the pouring spout, by connecting the siphon pipe to the intake pipe an additional feature is accomplished. During the siphoning process, simply blocking the siphon pipe at the valve would trap gasoline in the siphon hose. Removing the dispensing device from the container in this condition would result in leakage of the gas in the siphon hose creating an unwanted spill. By connecting the siphon pipe to the intake pipe, air can be pulled from the gas can through the intake pipe into the top of the siphon hose as the dispensing device is removed, allowing any gasoline in the siphon hose to drain back into the container.

Alternatively, the flow of gasoline may be started by adjusting the valve to the "Siphon" position, and forcing air into the gas can via the vent opening in one of the following two methods. A first method is to attach one end of a hose to the vent and blow into the other end of the hose until gas flows from the dispensing hose. Although this method is effective, it is not recommended if the liquid being dispensed is noxious. A second method is to attach to the vent opening an air pump such as the kind used to inflate children's toys, and pump air into the gas can until gas flows from the dispensing hose. In both methods, the gas will continue to flow even after the blowing or pumping stops.

In a second embodiment, the dispensing device includes a primer pipe in addition to the pouring spout, siphon pipe, intake pipe, and valve of the first embodiment. The primer pipe connects to the valve and extends from the top of the body of the dispensing device. The valve operates as in the first embodiment, with the additional feature of connecting the primer pipe to the intake pipe when the valve is in the "Siphon" position. An air pump such as the kind used to inflate children's toys is attached to the extending portion of the primer pipe.

In operation, the steps are the same as in the first embodiment with the following changes. Secure the vent cap so vapours do not escape. Adjust the valve to the "Siphon" position. Instead of tipping the gas can to start the flow of gasoline, use the air pump to force air into the gas can. Once gas starts to flow from the dispensing hose, disconnect the air pump from the primer pipe.

Alternatively, connect one end of a hose to the primer pipe and blow into the other end of the hose until gas flows from the dispensing hose. Although this method is effective, it is not recommended if the liquid being dispensed is noxious.

While an air-tight gas can is advantageous for starting the gas flowing when using the forced air method, even with some air leakage from the vent cap, only a single blow into the container will start the liquid flowing.

BRIEF DESCRIPTION OF THE DRAWINGS

FIG. 5 is a perspective view of the first embodiment of the present invention showing the intake pipe;

FIG. 6 is a perspective view of a valve;

DETAILED DESCRIPTION OF THE PREFERRED EMBODIMENT

The preferred embodiment of the present invention will now be described with references made to FIGS. 1–10.

Figure 1:
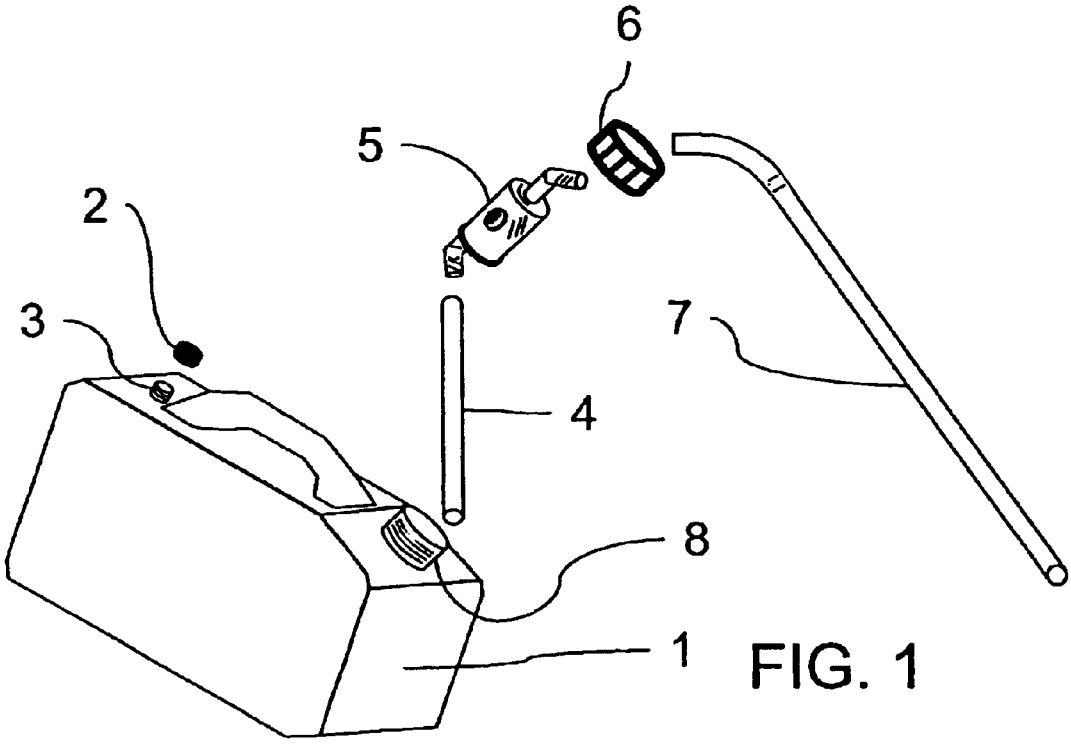
FIG. 1 is an exploded view of a gas can, a siphon hose, the first embodiment of the present invention, a filler ring cap, and a dispensing hose.

Referring to FIG. 1, a gas can 1, vent opening 3, vent cap 2, filler opening 8, siphon hose 4, dispensing device 5, filler ring cap 6 and dispensing hose 7 are shown. When these components are assembled and installed, no further components are required to dispense gasoline from gas can 1.

Figure 2:
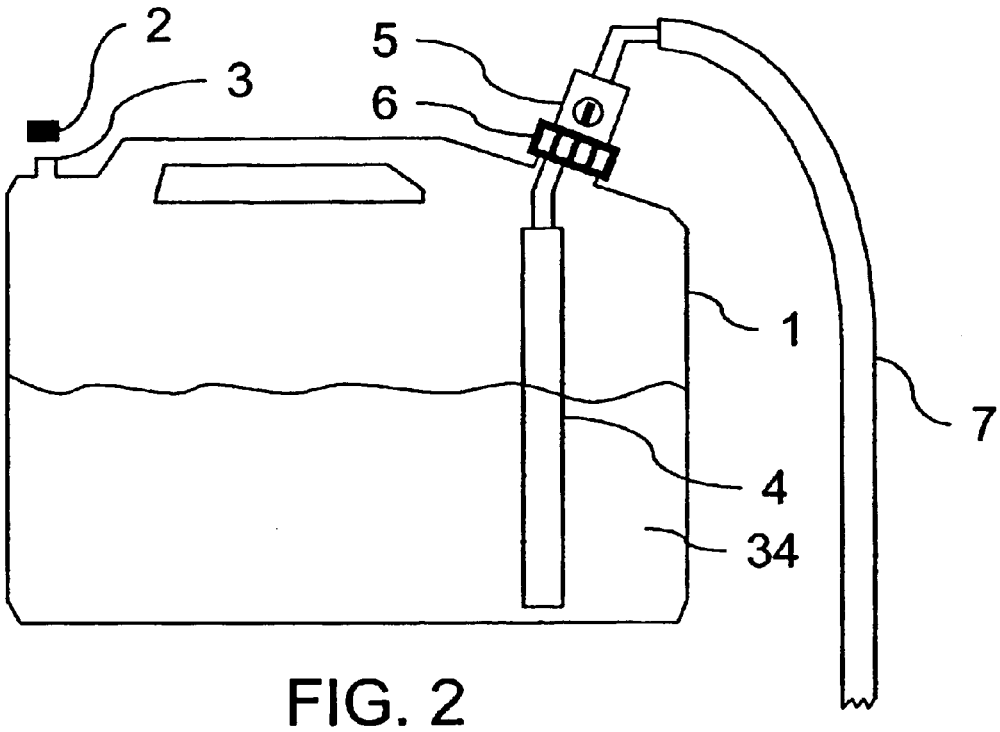
FIG. 2 is a side view of the first embodiment of the present invention attached to a gas can as in normal operation.

Referring to FIG. 2, the dispensing device 5 is shown in a typical operating configuration.

Figure 3:
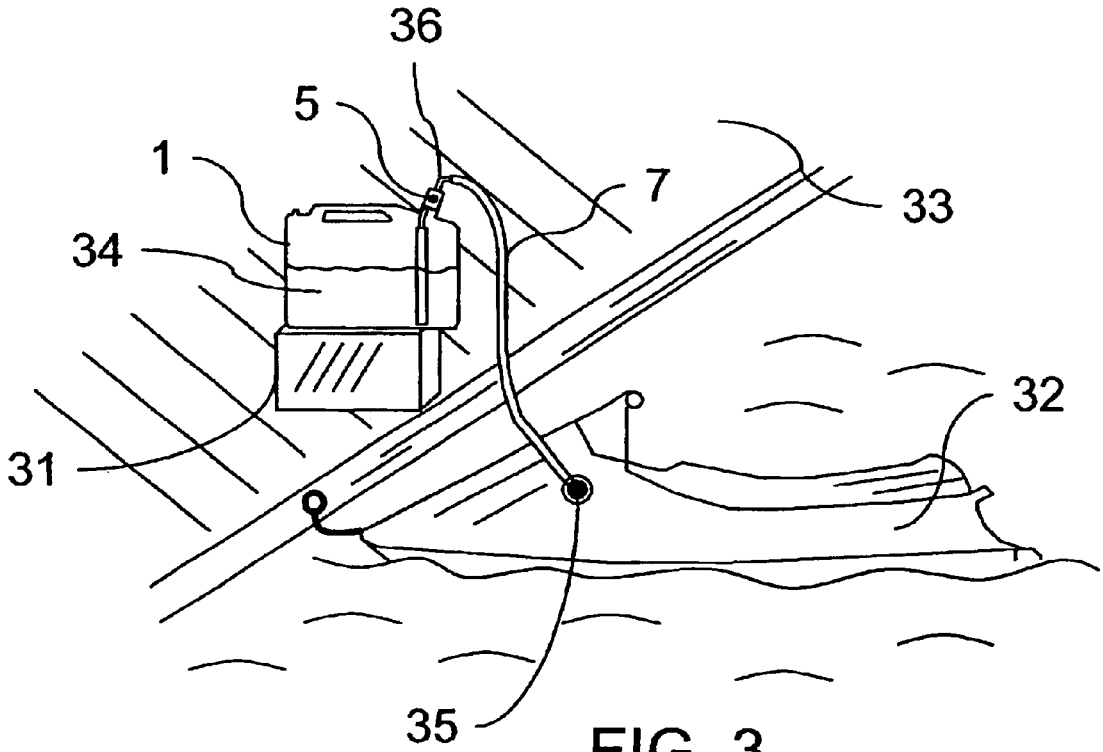
FIG. 3 is a perspective view of how the first embodiment of the present invention would be used to re-fuel a personal watercraft moored to a dock.

Referring to FIG. 3, a practical example of use of the dispensing device is shown. Personal watercraft 32 is moored to dock 33 for refueling. Dispensing device 5 is secured onto gas can 1. Dispensing hose 7 is connected at one end to the pouring spout 36 of dispensing device 5, while the other end is inserted into the gas lank opening 35 of personal watercraft 32. Gas can 1 is resting on box 31 ensuring that the level of the gasoline 34 is above the gas tank opening 35.

Figure 4:
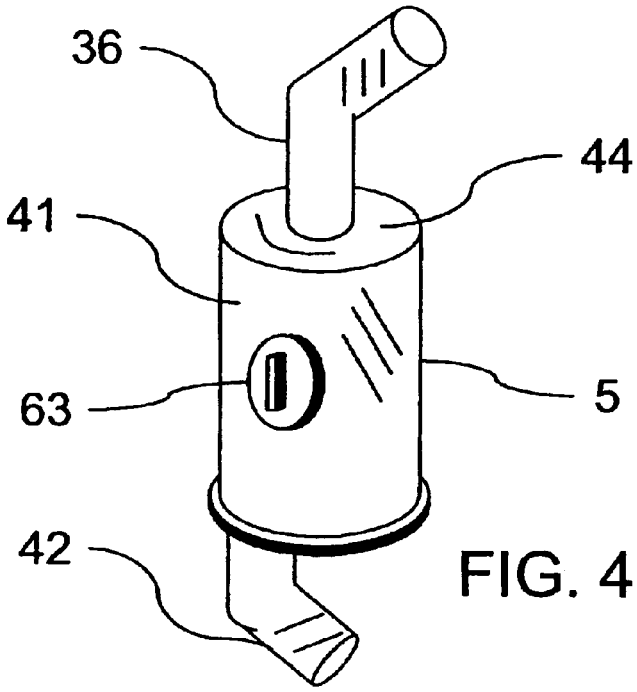
FIG. 4 is a perspective view of the first embodiment of the present invention.

Referring to FIG. 4, the external parts of dispensing device 5 are shown. Pouring spout 36 extends from the top 44 of the device body 41. Siphon pipe 42 extends from the base of the device body 41. Valve 63 is mounted in the side of the body 41.

Referring to FIG. 5, a view of the bottom of dispensing device 5 is shown Siphon pipe 42 extends from the base 52 of the device body 41. Intake pipe 51 is shown in the base 52.

Referring to FIG. 6, a perspective view of valve 63 is shown. Valve 63 is shaped like a thick disc, or hockey puck, with a conduit 64 passing completely through the disc. Alternate implementations include a sphere shaped valve, an implementation common in ball valves used both in household plumbing and garden watering systems.

Figure 7:
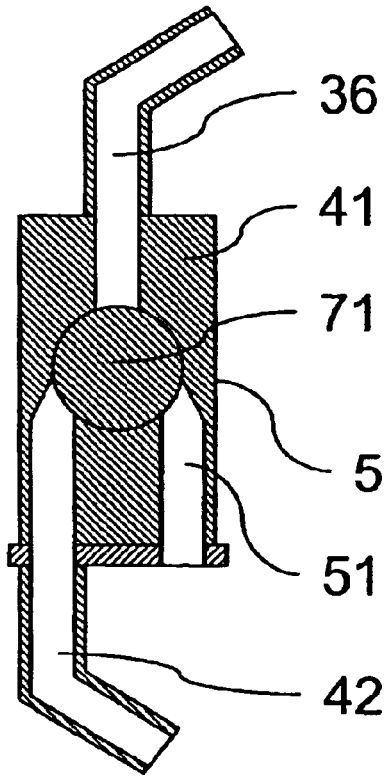
FIG. 7 is a cross-sectional view of the first embodiment of the present invention with the valve removed.
Figure 8:
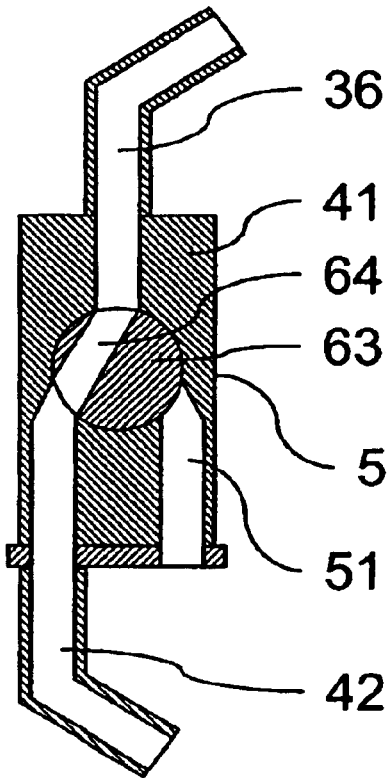
FIG. 8 is a cross-sectional view of the first embodiment of the present invention with the valve adjusted to the "Siphon", position.
Figure 9:
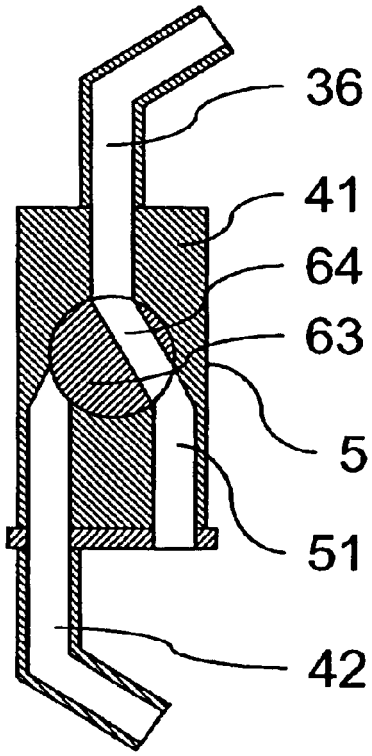
FIG. 9 is a cross-sectional view of the first embodiment of the present invention with the valve adjusted to the "Pour" position.
Figure 10:
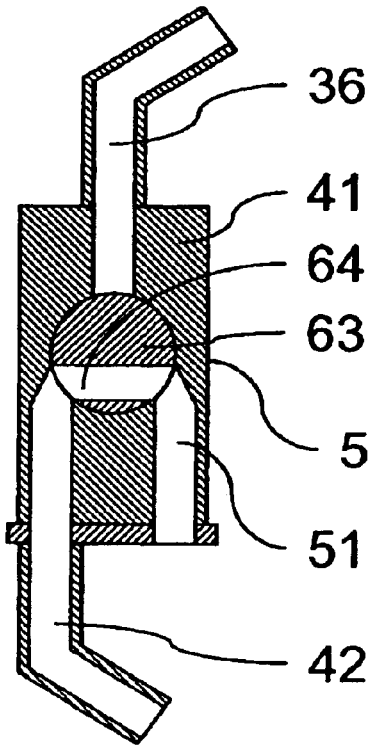
FIG. 10 is a cross-sectional view of the first embodiment of the present invention with the valve adjusted to the "Off" position.

Referring to FIGS. 7, 8, 9 and 10, cross sectional views of dispensing device 5 are shown. In FIG. 7, siphon pipe 42, intake pipe 51 and pouring spout 36 are shown connecting to circular cavity 71. Each connection to the circular cavity 71 is separated from its neighbour around the arc of the cavity by 120 degrees. Puck shaped valve 63 fits into circular cavity 71, and is shown in FIG. 8. The two ends of conduit 64 in valve 63 are 120 degrees away from each other around the arc of the circle. In FIG. 8, conduit 64 in valve 63 is shown connecting siphon pipe 42 to pouring spout 36. This is the "Siphon" position of the valve. In FIG. 9, valve 63 has been rotated 120 degrees from its position in FIG. 8 and conduit 64 is shown connecting intake pipe 51 to pouring spout 36. This is the "Pour" position of the valve. In FIG. 10, valve 63 has been rotated an additional 120 degrees from its position in FIG. 9 and conduit 64 is shown connecting siphon pipe 42 to intake pipe 51. This is the "Off" position of the valve.

Using the example of refueling a personal watercraft as shown in FIG. 3, the operation of the preferred embodiment of the invention is as follows.

Place the gas can 1 on a surface 31 positioned at a height above the gas tank opening 35 receiving the dispensed gasoline 34. Using filler ring cap 6, secure the dispensing device 5 onto the filler opening 8 of the gas can 1. Remove the vent cap 2. Place the dispensing hose 7 connected to the pouring spout 36 into the gas tank opening 35. Adjust the valve 63 to the "Siphon" position, thus connecting the siphon pipe 42 to the pouring spout 36 and establishing fluid communications. Tip the gas can 1 until the level of the gas inside the can is above the highest point of the dispensing hose 7, and wait until gasoline 34 starts to flow into the personal watercraft's gas tank. Return the gas can to the resting position. Gasoline will now flow into the gas tank until the level of the gasoline inside the gas can is below the level of the siphon hose 4. Adjust the valve to the "Pour" position, thus connecting the intake pipe 51 to the pouring spout 36. Tip the gas can until gasoline flows into the gas tank. Since there is very little gas in the can, the gas can is not heavy and can easily be held in an inverted position to drain the remaining gasoline.

A second embodiment of the present invention will now be described with references made to FIGS. 11–14

Figure 11:
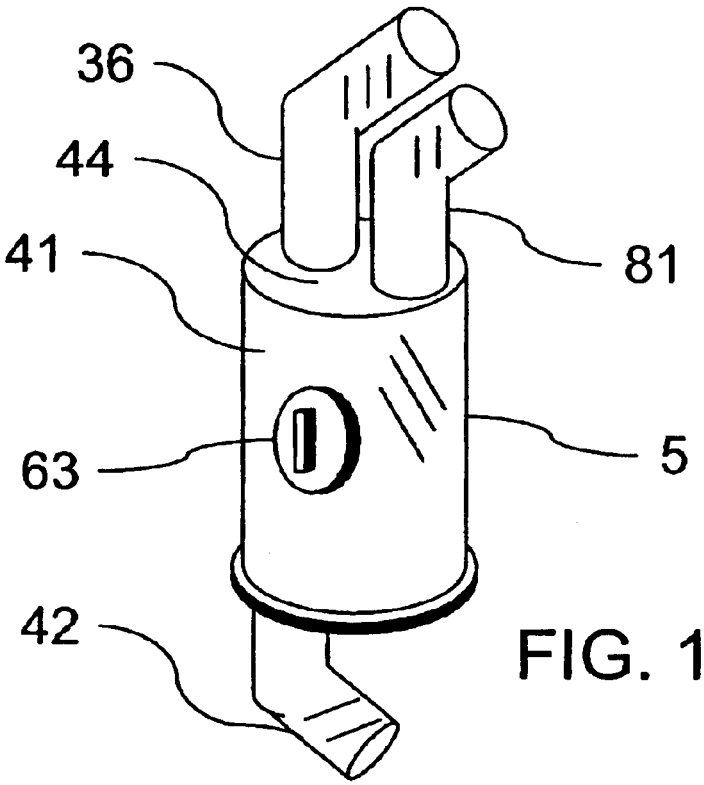
FIG. 11 is a perspective view of the second embodiment of the present invention.

Referring to FIG. 11, in the second embodiment of the present invention, the primer pipe 81 is shown extending from the top 44 of the device body 41.

Figure 12:
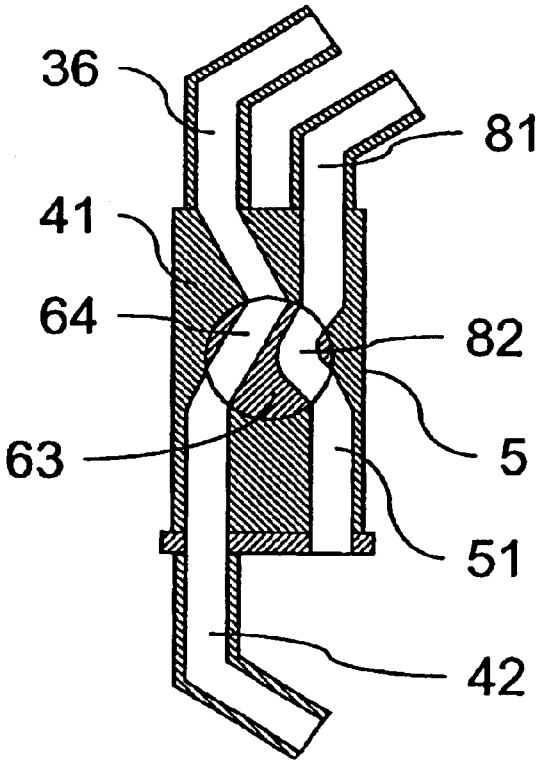
FIG. 12 is a cross-sectional view of the second embodiment of the present invention with the valve adjusted to the "Siphon" position.
Figure 13:
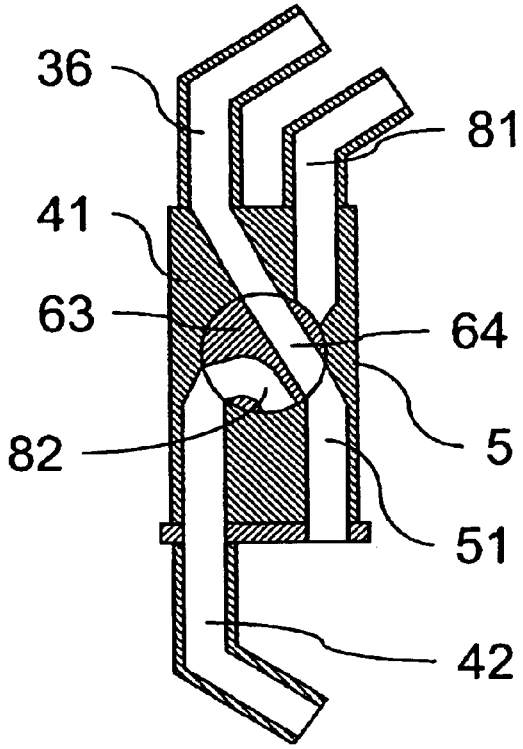
FIG. 13 is a cross-sectional view of the second embodiment of the present invention with the valve adjusted to the "Pour" position.
Figure 14:
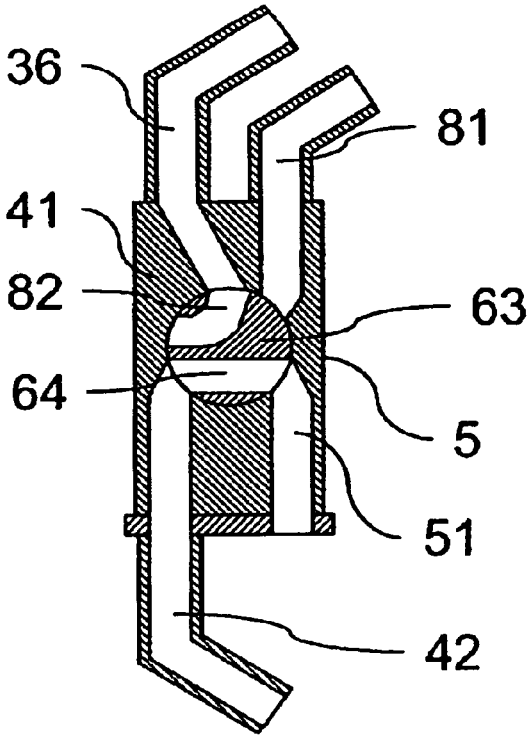
FIG. 14 is a cross-sectional view of the second embodiment of the present invention with the valve adjusted to the "Off" position.

Referring to FIGS. 12, 13 and 14, cross sectional views of dispensing device 5 in the second embodiment, the valve 63 has two conduits, 64 and 82. Conduit 64 makes the same connections for each of the valve positions as in the first embodiment. The difference in this second embodiment is shown in FIG. 12 with the valve in the "Siphon" position. Conduit 82 is shown connecting primer pipe 81 to intake port 51. In FIGS. 13 and 14, conduit 82 makes no connections and so has no effect on the operation of the dispensing device.

Using the example of refueling a personal watercraft as shown in FIG. 3, the operation of the second embodiment of the invention is as follows.

Place the gas can 1 on a surface 31 positioned at a height above the gas tank opening 35 receiving the dispensed gasoline 34. Using filler ring cap 6, secure the dispensing device 5 onto the filler opening 8 of the gas can 1. Secure the vent cap 2 onto the vent opening 3. Place the dispensing hose 7 connected to the pouring spout 36 into the gas tank opening 35. Adjust the valve 63 to the "Siphon" position. Attach an air pump, such as the kind used to inflate children's toys, to the extending portion of the primer pipe 81. Use the air pump to force air into the gas can until gasoline 34 starts to flow into the personal watercraft's gas tank. Gasoline will now flow into the gas tank until the level of the gasoline inside the gas can is below the level of the siphon hose 4. Adjust the valve to the "Pour" position, thus connecting the intake pipe 51 to the pouring spout 36. Tip the gas can until gasoline flows into the gas tank. Since there is very little gas in the can, the gas can is not heavy and can easily be held in an inverted position to drain the remaining gasoline.

While the preferred embodiment arranges the siphon pipe, intake pipe and pouring spout equidistant around the circular cavity 71, alternate implementations that do not have equidistant spacing are also possible. In non-equidistant implementations a single conduit 64 could be used to fully connect the siphon 42 and intake 51 pipes to the pouring spout 36 when the valve is in the "Siphon" and "Pour" positions respectively, while only partially connecting the siphon pipe 42 to the intake pipe 51 in the "Off" position. Since the partial connection allows sufficient air to enter the siphon pipe for the gasoline to drain back into the container, this implementation is also functional.

Although the invention has been described in connection with a preferred embodiment, it should be understood that various modifications, additions and alterations may be made to the invention by one skilled in the art without departing from the spirit and scope of the invention as defined in the appended claims.

I claim:

1. A liquid dispensing device mountable on a pour opening of a container, comprising:

a) a pouring spout for carrying liquid away from said container;

b) a protruding siphon pipe for extending into the container below the surface of liquid therein so that in a siphon mode the liquid can be siphoned from said container through said pouring spout;

c) an intake pipe shorter than said siphon pipe and normally located above the surface of liquid in said container so that in a pour mode liquid can be poured from said container when said container is tipped; and d) a valve assembly having at least two states for selectably either:

i. establishing fluid communication between said siphon pipe and said pouring spout in the siphon mode; or ii. establishing fluid communication between said intake pipe and said pouring spout in the pour mode;

whereby liquid can be initially siphoned out of said container through said siphon pipe and any residual liquid can be poured out of said container through said intake pipe.

2. The liquid dispensing device of claim 1 wherein said valve assembly has a further state wherein said valve partially or wholly establishes air communication between said siphon pipe and said intake pipe while at the same time preventing fluid communication between said siphon pipe and said pouring spout and preventing fluid communication between said intake pipe and said pouring spout.

3. The liquid dispensing device of claim 1, wherein valve assembly has a chamber containing a displaceable valve body, and said siphon pipe and said intake pipe communicate with ports opening into said chamber.

4. The liquid dispensing device of claim 3, further comprising a housing including said valve assembly, said intake pipe having a port that is flush with a lower end of said housing.

5. The liquid dispensing device of claim 1, wherein a hose is attached to said siphon pipe.

6. The liquid dispensing device of claim 3 wherein said displaceable valve body is disc shaped and rotatable within said chamber.

7. The liquid dispensing device of claim 3 wherein said displaceable valve body is spherical and rotatable within said chamber.

8. The liquid dispensing device of claim 3 wherein said chamber is circular and said pouring spout, siphon pipe and intake pipe are circumferentially arranged at substantially equal intervals around said chamber.

9. A liquid dispensing device mountable on a pour opening of a container, comprising:

a) a pouring spout for carrying liquid away from said container;

b) a primer pipe for attachment to a pump to permit air to be forced into said container;

c) a protruding siphon pipe for extending into the container below the surface of liquid therein so that in a siphon mode the liquid can be siphoned from said container through said pouring spout;

d) an intake pipe shorter than said siphon pipe and normally located above the surface of liquid in said container so that in a pour mode liquid can be poured from said container when said container is tipped; and e) a valve assembly having at least two states for selectably either:

i. establishing fluid communication between said siphon pipe and said pouring spout, and establishing air communication between said primer pipe and said intake pipe in the siphon mode; or ii. establishing fluid communication between said intake pipe and said pouring spout in the pour mode;

whereby liquid can be initially siphoned out of said container through said siphon pipe and any residual liquid can be poured out of said container through said intake pipe.

10. The liquid dispensing device of claim 9 wherein said valve assembly has a further state wherein said valve partially or wholly establishes air communication between said siphon pipe and said intake pipe while at the same time preventing fluid communication between said siphon pipe and said pouring spout and preventing fluid communication between said intake pipe and said pouring spout.

11. The liquid dispensing device of claim 9, wherein said valve assembly has a chamber containing a displaceable valve body, and said siphon pipe and said intake pipe communicate with ports opening into said chamber.

12. The liquid dispensing device of claim 11, further comprising a housing including said valve assembly, said intake pipe having a port that is flush with a lower end of said housing.

13. The liquid dispensing device of claim 9 wherein a hose is attached to said siphon pipe.

14. The liquid dispensing device of claim 11 wherein said displaceable valve body is disc shaped and rotatable within said chamber.

15. The liquid dispensing device of claim 11 wherein said displaceable valve body is spherical and rotatable within said chamber.

16. The liquid dispensing device of claim 11 wherein said chamber is circular and said pouring spout, siphon pipe and intake pipe are circumferentially arranged at substantially equal intervals around said chamber.

* * * * *